United States Patent [19]

Manton

[11] Patent Number: 4,784,704

[45] **Date of Patent: * Nov. 15, 1988**

[54] HIGH STRENGTH WELDABLE SEAMLESS TUBE OF LOW ALLOY STEEL WITH NIOBIUM

[76] Inventor: Robert B. Manton, 9726 E. 42nd St., Ste. 232, Tulsa, Okla. 74145

[ * ] Notice: The portion of the term of this patent subsequent to Apr. 26, 2005 has been disclaimed.

[21] Appl. No.: 2,270

[22] Filed: Jan. 12, 1987

[51] Int. Cl.[4] ..... C22C 38/22

[52] U.S. Cl. ..... 148/334; 148/909

[58] Field of Search ..... 428/586; 148/334, 909; 420/106, 110, 111; 138/177

[56] References Cited

FOREIGN PATENT DOCUMENTS 55-97423 7/1980 Japan ..... 148/334

60-114552 6/1985 Japan ..... 420/111

*Primary Examiner*—Deborah Yee

*Attorney, Agent, or Firm*—Head & Johnson

[57] ABSTRACT

A high strength weldable seamless tube of low alloy steel containing 0.24 to 0.28 percent carbon, 1.30 to 1.50 percent manganese, 0.15 to 0.35 percent silicon, not more than 0.01 percent sulphur, not more than 0.03 percent phosphorous, not more than 0.20 percent copper, 0.13 to 0.20 percent chromium, 0.15 to 0.60 percent molybdenum, 0.007 to 0.05 percent of aluminum, not more than 0.02 percent nitrogen, 0.02 to 0.04 percent titanium, 0.0007 to 0.0025 percent boron, 0.02 to 0.10 percent niobium, and the balance iron. The tube is preferably heated to an austenization temperature of about 1,670° F. and simultaneously internally and externally quenched by a special process that provides for high internal cooling rates followed by tempering at about 1,050° F.

4 Claims, 1 Drawing Sheet

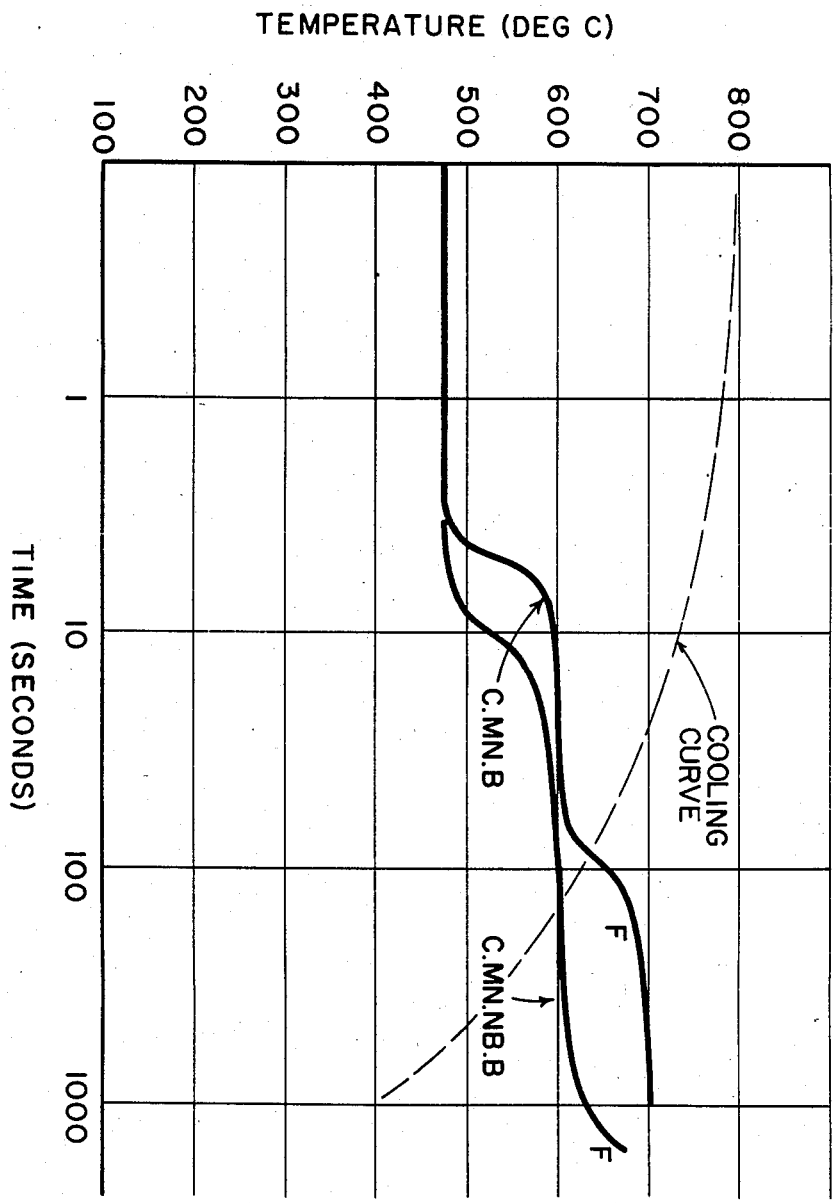
TEMPERATURE (DEG C)
800
700
600
500
400
300
200
100
TIME (SECONDS)
1
10
100
1000
COOLING CURVE
F
C.MN.B
C.MN.NB.B
F

HIGH STRENGTH WELDABLE SEAMLESS TUBE OF LOW ALLOY STEEL WITH NIOBIUM

SUMMARY OF THE INVENTION

This invention relates to an improved metal tubing, particularly useful in the petroleum industry or in other structural and pressure containing applications. The present invention is related to by subject matter with copending application Ser. No. 840,064, filed Mar. 17, 1986, entitled "A High Strength Weldable Seamless Tube of Low Alloy Steel".

Many industrial applications, such as exploration for oil and gas, demand tubular steel products of ever increasing strength. In addition to the requirement of increased tensile and yield strength, an important consideration, especially in tubing utilized in the petroleum industry and other industries where high yield strength for structural and pressure containing applications are required, is that of good weldability. Prior attempts to provide ultra-high strength tubing having obtained such strengths is the use of expensive alloying agents, that is, high concentrations of chromium, nickel or cobalt. In addition, the previously known ultra high strength steels very often exhibit very poor weldability. This poor weldability is characterized by the need for extensive pre-heat and post heat treatment cycles to obtain acceptable welds. An object of the present invention is to provide an ultra high strength steel tube which overcomes the limitations of the existing technology, that is, it does not use high concentrations of expensive alloying agents such as chromium, nickel and cobalt and at the same time produces a steel having good weldability which does not require extensive preheat and post heat treatment cycles to achieve successful welds.

The present invention provides an ultra high strength tube of an alloy including boron, molybdenum and niobium in a hypoeutectoid steel. To obtain the ultra high strength the tube is quenched and tempered severely both inside and outside, that is, using water for the quench under high agitation. An unexpected characteristic of the low alloy steel tube of this invention is that such severe quenching can be carried out without producing cracking, contrary to the general experience with the prior art steels.

For background information as to the state of the art relating to steel alloys and particularly such alloys as utilized for the production of high strength tubing, reference may be had to copending application Ser. No. 840,064 which is incorporated herein by reference.

A better understanding of the invention will be had now be reference to the drawing and to the description of the preferred embodiment.

DESCRIPTION OF THE DRAWING

The drawing is a transformation diagram showing how the addition of niobium shifts the start phase formation in an alloy.

DESCRIPTION OF THE PREFERRED EMBODIMENT

The present invention provides a unique alloy combined with quenching and tempering steps for achieving an ultra high stength tubing having good weldability characteristics. The unique alloying composition is based on a boron hypoeutectoid steel, coupled with very stringent quality control measures. It has been discovered that a seamless mechanical tube can be produced to an ultra high mechanical property that is useful in demanding applications such as those encountered in oil exploration and production. Such high strength tubing is achieved employing an alloy having the following chemical composition.

carbon: 0.24 to 0.28
manganese: 1.30 to 1.50
silicon: 0.15 to 0.35
sulfur: 0.010 maximum
phosphorous: 0.030 maximum
copper: 0.200 maximum
chromium: 0.13 to 0.20
molybdenum: 0.15 to 0.60
aluminum 0.007 to 0.050
nitrogen: 0.020 maximum
titanium: 0.020 to 0.40
boron: 0.0007 to 0.0025
niobium: 0.02 to 0.10

An alloy having this chemical composition provides a superior tube for use in the industrial applications, however, in order to attain the ultra high strength which is desirable it is necessary that the tubing be carefully heat treated. This is accomplished by first raising the tube having the chemical composition described above to an austenization temperature of about 1,670° F. Thereafter it is aggressively water quenched internally and externally simultaneously, using water under high agitation. It has been discovered that whereas such agitated quenching of prior art steels would tend to produce cracking, such does not occur utilizing the steel with the composition above described. After the aggressive quenching, the tube is tempered at a temperature of about 1,050° F. followed by air cooling.

The present invention utilizes the known high hardenability effects of a C-Mn-NB-B steels and adds chromium and molybdenum is specific quantities that allow for high yield strength levels while a degree of weldability that is superior to metals of similar strength levels.

The invention is unique with respect to prior art steel by the ability of the tubing made from the above designed chemical composition to achieve high yeild strength levels of 135,000 to 150,000 psi. In order to achieve an increase in yield strengths, prior art steels generally utilize increasing carbon, chromium and nickel additions. This invention utilizes lower concentrations of alloying elements in unique combinations to achieve high yield strengths. In the prior art in some instances high levels of vanadium are used to increase strength. The use of large quantities of chromium, nickel and vanadium not only substantially increases the cost of such prior art steels but this method of obtaining high strength levels often results in decreased weldability. Such prior art steels can usually be welded only utilizing elaborate procedures requiring high pre-heat temperatures and extensive post weld heat treatment cycles in addition to very stringent cleanliness standards in order to avoid cracking in the weldments. In contrast, the weldability of the tube of the present invention is very comparable to the weldability of prior art steels having much lower yield strength.

Most prior art steels specify a maximum sulphur content of about 0.04 percent whereas in the present invention the maximum sulphur is much less, that is, 0.01 percent. It has been determined that by lowering the sulphur content, the ductility and toughness of the steel is increased.

The hardenability mechanism used in the low alloy steel of this invention is unique in fields of the relevant strength class. The mechanism of using molybdenum in combination with boron is well known as revealed in such article as by Maitre Pierre, J. Rofes-Pernias and D. Thivellier, "Structure-Properties Relationships in Boron Steels", "Boron in Steels", Proceedings, TMEAINE International Symposium, Milwaukee, Wis., Sept. 18, 1979.

In addition, the use of niobium in steels has been discussed in an article by Irvine, K. J. "A Comparison of the Bainite Transformation With Other Strengthening Mechanisms in High Strength Steels", The British Steel Corp., Climax Molybdenum Symposium, Dolder Grant Hotel, Zurich, Switzerland, May 6, 1969. However, the steel of the present invention is unique in that the two metallugurical relationships that are known in the prior art, that is, the effect of the combination of boron and molybdenum, and the combination of niobium and boron, are combined in a tube in conjunction with a heat treatment scheme which gives greatly improved mechanical properties in a seamless tube. Test have produced tubes with wall thickness up to 2½ inches having the following properties:

Minimum Ultimate Tensile Strength: 145,000 psi.

Minimum Yield Strength: 135,000–150,000 psi.

Elongation, percent, Minimum: 15

In order to achieve these ultimate high strengths the tube having the composition described was treated at an austenization temperature of 1,670° F. by a simultaneous agitated water inside and outside quench followed by tempering at 1,050° F. The treatment was concluded with air cooling of the tube. The internal quench is carried out at a high cooling rate.

The drawing shows how the additional of the niobium to a low carbon alloy steel having chromium, molybdenum and boron shifts the starting phase formation in the alloy. More specifically, the drawing is a "Continuous Cooling Transformation (CCT) Diagram". Such a diagram is useful for illustrating what types of microconstituents may form in a steel on cooling during a heat treatment process. The type and quantity of particular microconstituents play a direct role in the strength and ductility of a pipe or tube formed of such steel. A cooling curve is shown on the drawing. This curve may be related to a particular cooling rate (°C./sec) as may be experienced in the center of a thick tube wall section during a quench hardening treatment. In order to reach high strength levels, the prior art has relied on the addition of large percentages of alloying elements such as chromium, nickel and carbon. The drawing shows that for a given cooling rate a carbon, manganese, boron steel will transmit through the time-temperature region that is conducive to the formation of the phase ferrite(F), the formation of this phase in this particular system will result in lower than desired strength levels. With the addition of niobium and boron, (NB and B), the alloy will form the more desirable bainite and martensite micoconstituents resulting in high strength levels.

The invention provides a unique seamless, low alloy tube having ultra high strength and greatly increased weldability compared to the tubes available in the prior art.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A high strength weldable seamless tube which has been heated to an austentization temperature of about 1,670° F. and simultaneously internally and externally quenched and containing 0.24 to 0.28% carbon, 1.30 to 1.50% manganese, 0.15 to 0.35% silicon, not more than 0.01% sulfur, not more than 0.03% phosphorus; not more than 0.20% copper, 0.13 to 0.20% chromium, 0.15 to 0.60% molybdenum, 0.007 to 0.05% aluminum, not more than 0.02% nitrogen, 0.02 to 0.04% titanium, 0.0007 to 0.0025% boron, 0.02 to 0.10% niobium, and the balance iron, and wherein said tube has a minimum yield strength of about 135,000 psi.

2. A high strength weldable seamless tube according to claim 1 in which the tube has a minimum ultimate tensile strength of about 145,000 psi; has a minimum yield strength of 135,000 psi; and has a minimum elongation of about 15%.

3. A high strength weldable seamless tube according to claim 1 wherein the austenized tube has been tempered at about 1,050° F. and thereafter air cooled.

4. A high strength weldable seamless tube according to claim 1 wherein the heated and quenched tube has a wall thickness up to 2½" and has a minimum ultimate tensile strength of about 145,000 psi, a yield strength of about 135,000 to 150,000 psi and elongation of about 15% minimum.

* * * * *